US008122605B2

(12) United States Patent
Votolato

(10) Patent No.: US 8,122,605 B2
(45) Date of Patent: Feb. 28, 2012

(54) UTILITY KNIFE WITH COUNTER-RECIPROCATING BLADE AND GUARD

(76) Inventor: Earl Votolato, Newport Beach, CA (US)

( * ) Notice: Subject to any disclaimer, the term of this patent is extended or adjusted under 35 U.S.C. 154(b) by 51 days.

(21) Appl. No.: 12/489,976

(22) Filed: Jun. 23, 2009

(65) Prior Publication Data

US 2009/0271988 A1 Nov. 5, 2009

Related U.S. Application Data

(63) Continuation-in-part of application No. 11/621,208, filed on Jan. 9, 2007, now abandoned.

(51) Int. Cl.
*B26B 1/02* (2006.01)

(52) U.S. Cl. ..... 30/2; 30/156; 30/158; 30/286

(58) Field of Classification Search ..... 30/2, 156, 30/158, 286; 83/397, 398
See application file for complete search history.

(56) References Cited

U.S. PATENT DOCUMENTS

| | | | | |
|---|---|---|---|---|
| 1,656,243 | A | 1/1928 | Seeley | |
| 2,076,007 | A | 4/1937 | Smith | |
| 3,002,273 | A | 10/1961 | Merritt | |
| 4,539,988 | A * | 9/1985 | Shirley et al. | 606/182 |
| 4,715,374 | A * | 12/1987 | Maggio | 606/182 |
| 5,207,696 | A * | 5/1993 | Matwijcow | 606/167 |
| 5,893,311 | A | 4/1999 | Huang | |
| 5,937,720 | A | 8/1999 | Itzov | |
| 6,718,640 | B1 | 4/2004 | John | |
| 7,575,583 | B1 * | 8/2009 | Schraga | 606/182 |
| 7,673,778 | B2 * | 3/2010 | Sze | 225/104 |
| 7,704,265 | B2 * | 4/2010 | Schraga | 606/182 |
| 2005/0193568 | A1 * | 9/2005 | Peyrot et al. | 30/162 |

* cited by examiner

*Primary Examiner* — Kenneth E. Peterson
(74) *Attorney, Agent, or Firm* — Fish & Associates, PC

(57) ABSTRACT

A utility knife has a counter-reciprocating blade and blade guard. Preferred utility knifes have an internal mechanism comprising several components that are advantageously coupled via one or more pivot points. Though an appropriate arrangement of pivot points, both stationary pivot points and translating pivot points, the blade and guard counter-reciprocate such that forced retraction of the guard results in forced extension of the blade. While the internal mechanism is in a locked position, the guard locked. Actuation of a trigger can unlock the internal mechanism, which releases the blade guard. Preferably a single actuation of the trigger provides for a single use of the knife.

11 Claims, 6 Drawing Sheets

UTILITY KNIFE WITH COUNTER-RECIPROCATING BLADE AND GUARD

This application is a continuation-in-part of U.S. patent application having Ser. No. 11/621,208 filed on Jan. 9, 2007now abandoned. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is utility knives.

BACKGROUND

Traditionally, utility knives have a blade that either (a) is in a fixed, extended position relative to a knife handle but is externally covered by a blade cover or (b) is stored internally in a cover until the blade is manually extended by sliding the blade out of the knife's handle. Some progress has been made to protect users from unprotected blades. For example, more recent utility knifes include blades that retract into a handle or a housing when not in use, or that can be covered by a blade cover or guard. However, such knifes still expose a blade in an unprotected position that can cause accident injury to a user.

The problem of accidental injury has been long recognized, with numerous solutions put forward at various times. U.S. Pat. No. 4,980,977 to Matin et al. titled "Safety Core Cutting Knife" (January 1991), for example, describes a knife having a safety guard that guards a blade when not in use, and automatically retracts as the blade is removed from a work piece. The guard has a manually triggered self-locking release assembly that automatically relocks the guard when retracted. Unfortunately, Matin's locking mechanism is external to the housing. Such a configured can be dangerous because the mechanism can readily jam due to debris. The debris could easily interfere with the assembly's locking or unlocking functions. In addition, Matin's safety guard pivots externally from the housing and off of the blade, rather than being retracted into the housing. Allowing the blade guard to pivot or otherwise move in an exposed manner increases a risk of the guard interfering with the knife's operation, with a target work piece, or with the user.

U.S. Pat. No. 5,878,501 to Owens et al. titled "Utility Knife with Retractable Blade Guard" (March 1999) describes a utility knife having a blade guard where the blade guard can be withdrawn to expose a cutting edge of a blade. Unfortunately, the Owens configuration allows the cutting edge of the blade to remain exposed across multiple cuts or uses.

Still other utility knife designs exist that afford some level of protection. For example, a blade can be coupled to a sliding mechanism disposed within a knife handle. A user can push the sliding mechanism to move the cutting edge of the blade from the handle into an exposed cutting position. The sliding mechanism can also be spring-loaded in a manner that automatically retracts the blade into the handle once a pushing force is removed from the sliding mechanism. Preferred knives should also offer a locking mechanism coupled to the blade or blade guard that prevents accidental extension of the blade.

More recently the present inventor pioneered utility knives having a mechanism that automatically re-locks a protective blade guard. For example, U.S. Pat. No. 7,509,742 to Votolato titled "Safety Cutting Apparatus" (March 2009) discloses a utility knife where a blade guard automatically re-locks into a closed position covering a cutting edge of a blade after a single cut. Another example includes U.S. Pat. No. 7,356,928 to Votolato titled "Utility Knife with Safety Guard Having Reduced Play" (April 2008) where a blade guard retracts into a knife handle and can re-lock into a safety position after use.

Ideally, a utility knife should protect users from a cutting edge of a blade by both a blade guard and a handle of the knife. In such an approach, the blade can be retracted into the knife handle when not in use, and can be extended for a cutting operation. Additionally, a blade guard can protect the user from the extended cutting edge, and can move out of position when the knife is applied to a surface to be cut. It has yet to be appreciated such a utility knife can be manufactured where the knife blade and blade guard pivot relative to each other in a counter reciprocating fashion within a handle of the knife.

Thus, there is still a need for a utility knifes with lockable blade guards.

Unless the context dictates the contrary, all ranges set forth herein should be interpreted as being inclusive of their end-points and open-ended ranges should be interpreted to include only commercially practical values. Similarly, all lists of values should be considered as inclusive of intermediate values unless the context indicates the contrary.

SUMMARY OF THE INVENTION

The inventive subject matter provides apparatus, systems and methods in which a utility knife comprises a counter-reciprocating knife blade and blade guard. In one aspect of the inventive subject matter, a utility knife comprises a knife handle that forms a housing, in which is disposed the blade and the blade guard. In a preferred embodiment, both the knife blade and the blade guard are at least partially disposed within the housing. In some embodiment, the blade can be fully retracted within the housing when the blade is not in use. The blade and blade guard can be pivotally coupled to interior surfaces of the housing. In a preferred embodiment, when the blade guard retracts into the housing via a pivoting motion relative to the housing, the blade guard's pivoting motion causes the blade to extend out of the housing in via a second pivoting motion that is counter to that of the blade guard.

The counter-reciprocation motion of the blade and the blade guard can be achieved via a coupling mechanism. In a preferred embodiment, the coupling mechanism comprises at least three pivot points. A first stationary pivot point is used to couple a blade holder to the housing of the utility knife where the first pivot point remains stationary to the handle while allowing the blade holder to pivot relative to the housing. A second stationary pivot point can be used to couple a blade guard to the housing of the knife and where the second pivot point also remains stationary with respect to the handle while allowing the guard to pivot relative to the housing. Another translating pivot point can be used to couple the blade holder to the blade guard. The translating pivot can move relative to the knife housing as the blade and the blade guard counter-reciprocate with respect to each other.

Preferred utility knifes also comprise a locking mechanism configured to lock a blade guard in an extended closed safety position when not in use. In some embodiments, the locking mechanism can include a pawl and spring where the spring biases the blade guard into a closed position. The pawl can prevent the blade guard from retracting when the knife is in a locked state. The locking mechanism can also include a trigger where actuation of the trigger unlocks the blade guard and allows the blade guard to retract. Preferred locking mechanisms allow a single use of the knife. Once the blade guard is restored to a safety position, the trigger can be actuated again to release the guard.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
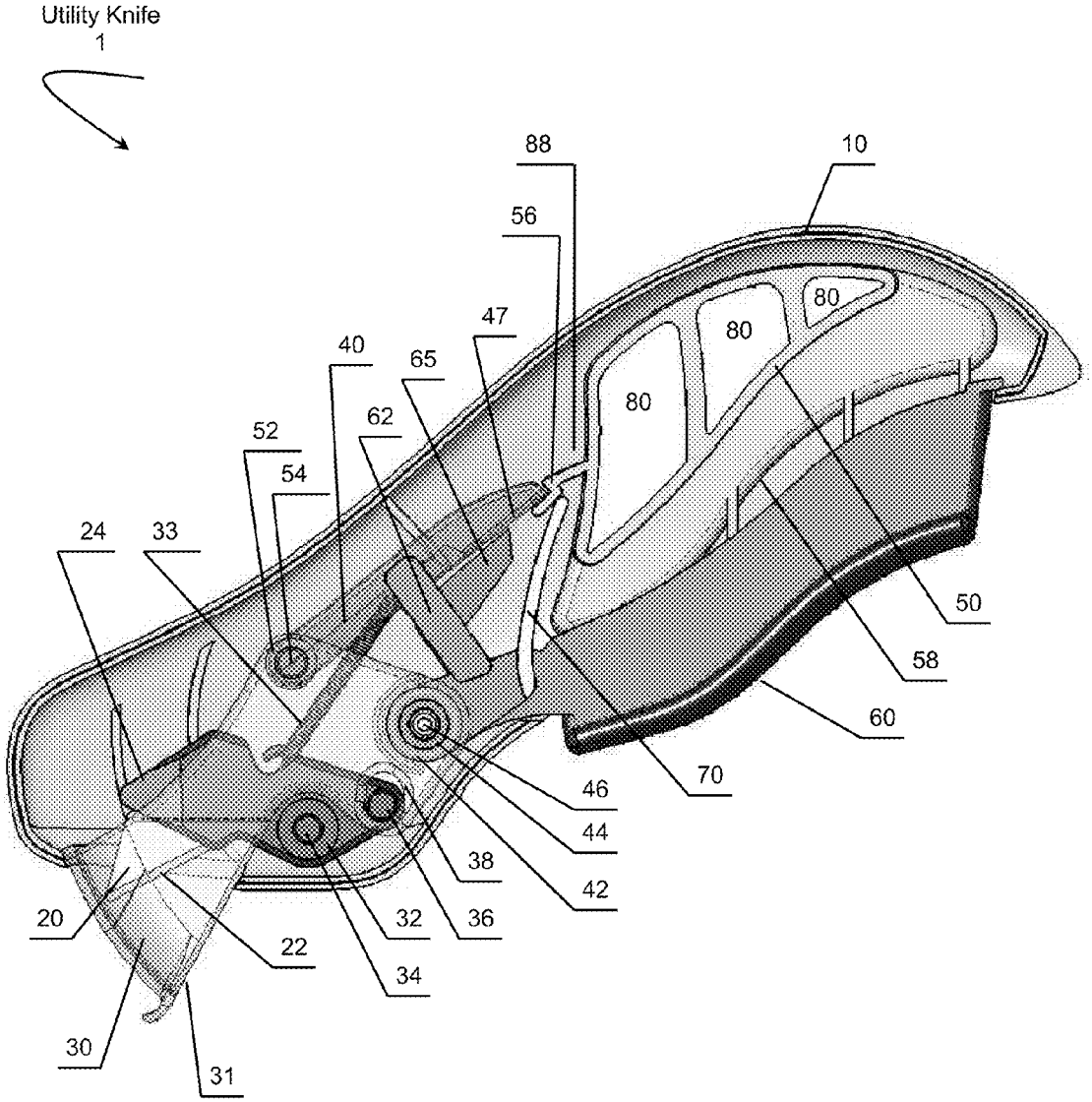
FIG. 1 is a cut away side view of an example utility knife.
Figure 2:
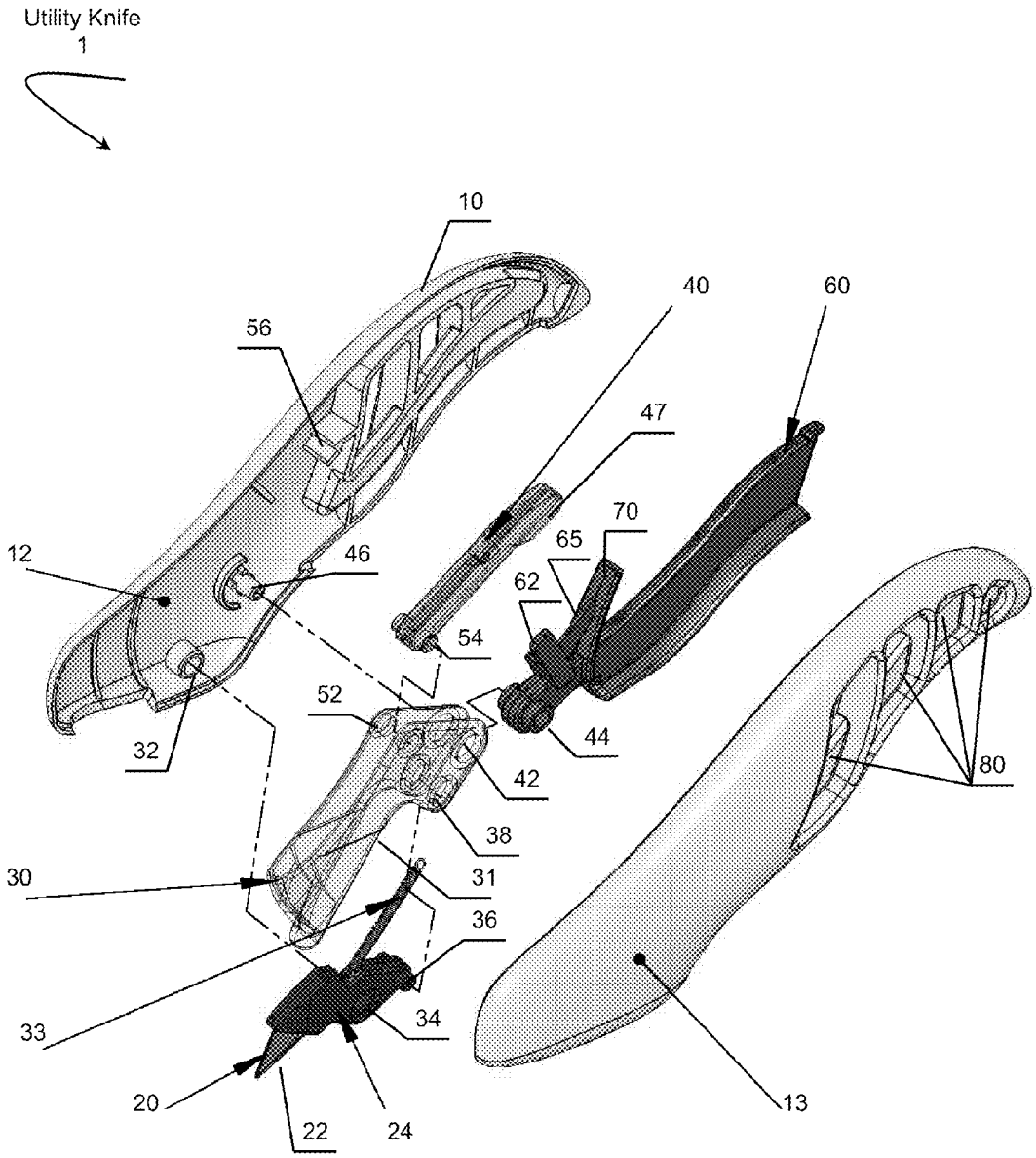
FIG. 2 is an exploded view of the example utility knife.

In FIG. 1, a utility knife 1 generally comprises a housing 10 (only the front portion of which is shown), a blade 20, a blade guard 30, a pawl 40, and a trigger 60. FIG. 2 presents an exploded view of utility knife 1.

The following discussion uses various terms to describe relative motion of the components of knife 1. One should appreciate that the various motions are discussed relative the illustrations, and should not be considered as limiting the inventive subject matter. For example, "upward" means a motion approximately toward the top or superior side of knife 1 and loosely to the top of the page. "Downward" means a motion toward the bottom or inferior side of knife 1 and loosely to the bottom of the page. In a similar fashion, "forward" means moving toward the working end of the knife 1; loosely toward the left side of the page, and "rearward" means moving toward the distal, non working-end of the knife 1; loosely toward the right side of the page.

Housing 10 is preferably sized and dimensioned to fit comfortably in a hand of a user. Housing 10 can be made of any suitable material, including metals, alloys, ceramics, or plastics. In some embodiments, housing 10 can include a cavity (not shown) that can be used for storing additional spare blades or other tool bits. Housing 10 is configured in a ambidextrous fashion where knife 1 can be used by either a right or a left hand. Alternatively, knife 1 could comprise contours on external surfaces of housing 10. In some embodiments, the contours can provide a better fit specifically for a right or a left hand. Housing 10 can also including one or more of depressions 80 to provide a better grip or provide additional comfort to the user. Depressions 80 can extend partially into housing 10, or can completely pass through housing 10. In some embodiments, depressions 80 can be formed from one or more ribs 50 molded into housing 10, possibly molding into housing pieces 12 or 13.

Housing 10 preferably provides one or more internal pivot points by which internally disposed assemblies can pivot relative housing 10. For example, housing 10 can include a pivot point represented as a circular slot 32 into which pivot pin 34 of blade holder 24 can be inserted. Another example includes a pivot point comprising pin 34 located on an internal surface of housing 10, slot 44 on trigger 60, and slot 42 in blade guard 30. The various pivot points are described more fully below.

One should appreciate that a pivot point can be formed by using a pin as a pivot axis where the pin inserts into a groove or slot. In some embodiments, a pin of a pivot can be located on housing 10, possibly formed during an injection molding process, were the pin inserts into a slot on blade holder 24 or guard 30. In other embodiments, the pin of the pivot point could be positioned on blade holder 24 or guard 30 where the pin inserts into a slot molded into housing 10. As used herein, the term "pivot point" euphemistically represents pin-slot assembly regardless of the number of pins or slots used to form the pivot point.

Blade 20 is preferably triangular shaped at one or both ends. In a preferred embodiment, blade 20 has at least one cutting edge 22, preferably a straight cutting edge. Blade 20 is preferably made of non-rusting alloy. Other blade materials are also contemplated including plastics, wood, ceramics, or other materials capable of carrying a cutting edge 22.

Although a blade 20 preferably comprises one or more straight cutting edges, it is also contemplated that blade 20 could comprise other shapes. For example, blade 20 could comprise a circular blade with a circular cutting edge as described in U.S. Pat. No. 5,765,289 to Schulz et al. titled "Rotary Cutter" (June 1998).

In a preferred embodiment, blade 20 is held within blade holder 24. Blade holder 24 can couple to housing 10 via at least a pivot point comprising pin 34 and slot 32 (e.g., a slot in housing 10).

Figure 3:
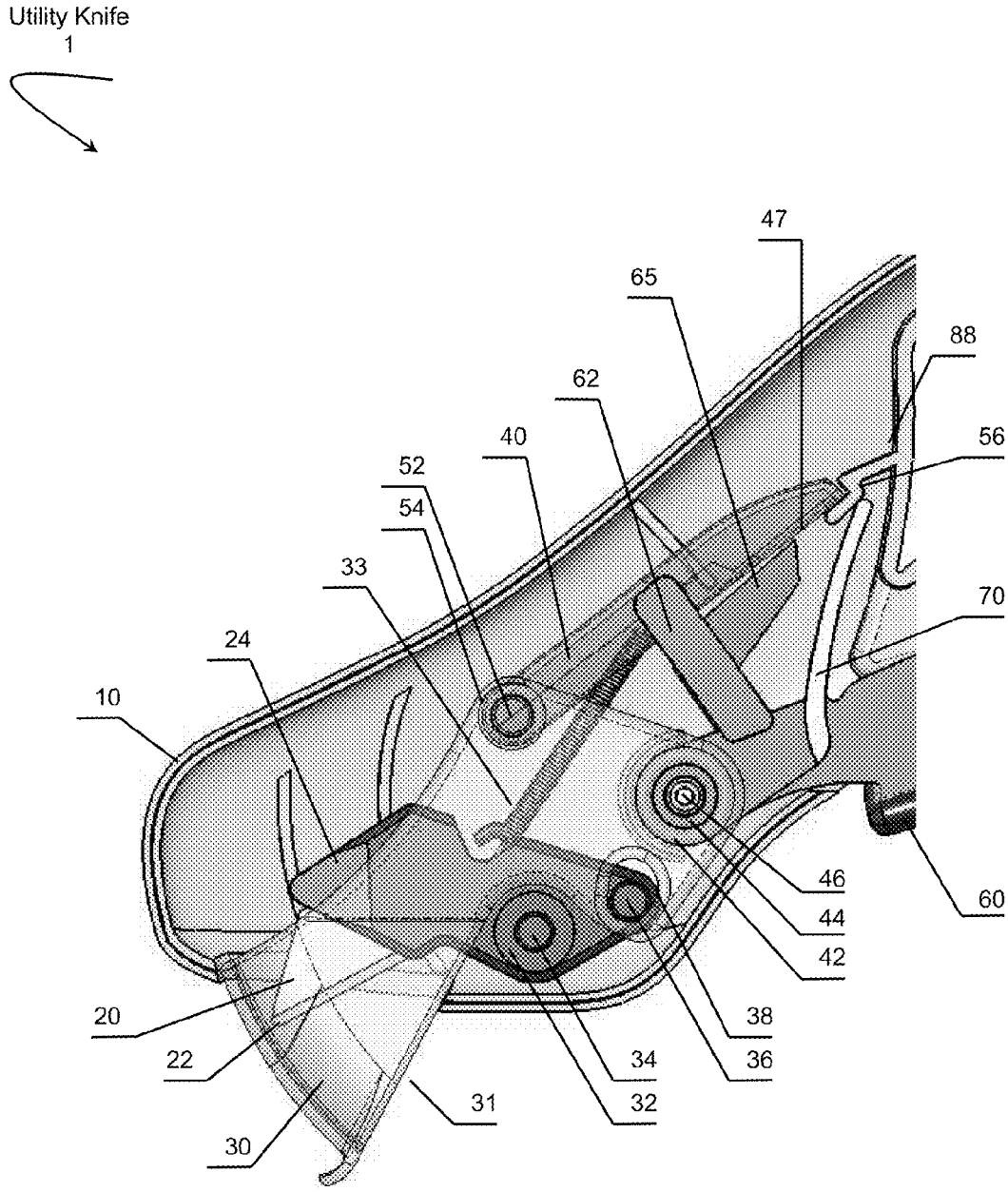
FIG. 3 is a cut away side view showing a close up of a locking mechanism and where the trigger has not been actuated

Blade guard 30 generally guards the blade 20 when guard 30 is in a fully deployed safety closed position (see FIG. 3). When blade 20 is in use, blade guard 30 can retract into housing 10 in a retracted position (see FIG. 5) which cause blade 20 to rock forward into an exposed position. In a preferred embodiment, blade guard 30 couples to housing 10 via at least a pivot point comprising pin 46, and slots 44 and 42. Blade guard 30 also preferably comprises opening 31, through which at least cutting edge 22 can extend. Blade guard 30 preferably is formed from a translucent material (e.g., a plastic) to allow a user to view a position of blade 20. Alternatively, blade guard 30 can be made of other materials including metal, wood, opaque plastics, ceramic, or other durable materials.

Blade holder 24 and blade guard 30 are preferably coupled together and coupled to housing 10 via a multi-pivot coupling mechanism. In a preferred embodiment, the coupling mechanism comprises at least three pivot points, and more preferably at least four pivot points as shown in FIG. 1. It is contemplated that any number of pivot points beyond four could also be used to ensure proper counter-reciprocation of blade guard 30 and blade 20. In the example shown, blade holder 24 couples to blade guard 30 via a pivot point comprising pin 34 located on holder 24 that inserts into slot 38 of guard 30. In addition the example coupling mechanism includes pivot points defined by pin 34 that pivotally couples to housing 10 and defined by pin 46 of housing 10 that inserts into slots 44 and 42.

In some embodiments, blade guard 30 can also include a pivot point defined by pin 52 located on pawl 40 that inserts into slot 54 of guard 30.

One should note the differences among the various pivot points. Both pivot points defined by pins 34 and 46 are stationary pivot points due to coupling to housing 10, and where the pivot points rotate relative to housing 10, but do not move or translate relative to housing 10. The pivot point defined by pin 36, on the other hand, is a translating pivot point where it can move relative to housing 10 as well as allows holder 24 and guard 30 to rotate relative to each other and to rotate relative to housing 10. For example, as guard 30 retracts or rocks back into housing 10 via pivoting on pin 46, slot 38 moves upward (i.e., upward relative to the illustration of knife 1). As slot 38 moves upward, it carries pin 36 along in an upward direction. The pivot point defined by pin 52 is also a translating pivot point because it can move forward or rearward relative to housing 10.

Pawl 40 operates as part of a locking mechanism to secure blade guard 30 into a locked, safety closed position, and also operates to control the pivoting motion of guard 30. In a preferred embodiment, pawl 40 pivotally couples to guard 30 via a pivot point defined by pin 52. As guard 30 rotates around the pivot point defined by pin 46, pawl 40 slides within housing 10 preferably guided by one or more ribs 50. In the example shown, pawl 40 prevents guard 30 from pivoting by engaging with stop 56. In a preferred embodiment, pawl 40 remains in a locked position against stop 56 via a force provided by spring 33 as discussed below. When pawl 40 is released from stop 56, pawl 40 can move rearward along a rib 50 until stopped by stop 88. Spring 33 preferably provides a returning force that causes pawl 40 to slide forward back into a locked position at stop 56. Horizontal movement of pawl 40 between stop 88 and stop 56 at least in part controls how far blade guard 30 can pivot about pin 46.

Pawl 40 is biased forward in a locked position via a force provided by spring 33. As shown in FIG. 1 and FIG. 3, preferably spring 33 couples to blade holder 24 and to a hook on pawl 40. Spring 33 is preferably is under tension when knife 1 is a safety position where blade 20 is pulled into a safety retracted positing within housing 10. Spring 33 also pulls pawl 40 forward toward holder 24. Because holder 24 is pulled into a retracted position, holder 24 pivots about pin 34 causing pin 36 to move or translate in a downward direction. As pin 36 moves in a downward direction, it carries slot 38 downward as well, which in turn causes blade guard 30 to rock forward by pivoting about pin 46. Thus spring 33 can bias blade 20 into a retracted safety position, bias blade guard 30 into a close safety position, and can also bias pawl 40 into a locked position so that it is adjacent to stop 56.

Pawl 40 is preferably constructed of a single, continuous piece of material. In a preferred embodiment, pawl 40 is molded from a plastic. Alternative materials include wood, metal, ceramic, or other durable, stiff materials. Pawl 40 also preferably includes catch 47 on a lateral side of pawl 40. Catch 47 engages with arm 65 of trigger 60 to release pawl 40 from a locked position as discussed below. Pawl 40 also preferably includes a hook, to which spring 33 couples.

Trigger 60 preferably comprises a single, unitary piece of material having connector 62, lifting arm 65, return lever 70, and slot 44. Acceptable materials include plastic, metal, wood, ceramic, or other durable materials. It should be appreciated that trigger 60 could also comprise discrete components coupled together. Lever 70 can engage with a rib 50, possibly the under side of stop 56 as shown, to supply a return force that causes trigger 60 to remain in an un-actuated state. As trigger 60 is depressed, lever 70 will flex, supplying some resistance to actuation of trigger 60, and supplying a return force in a manner where trigger 60 will automatically return to the un-actuated state upon release of trigger 60.

Connector 62 extends upward from a main body of trigger 60 and connects to lifting arm 65. Lifting arm 65 extends from connector 62, and is sized and dimensioned to engage catch 47 of pawl 40 when trigger 60 is actuated, and while the internal locking mechanism is in a locked state.

Trigger 60 preferably couples to housing 10 in a pivotal fashion via pin 46 and slot 44, which combine to form a stationary pivot point. The configuration shown allows trigger 60 to pivot in an upward direction (e.g., counter-clockwise with respect to the page) for actuation, or downward (e.g., clockwise with respect to the page) when released. One should note that the pivot point defined by pin 46 can be considered a nested pivot point around which multiple components pivot. Furthermore, it should be noted that as trigger 60 is actuated, it pivots in a first direction (e.g., counter-clockwise as shown in the illustration of FIG. 1), while blade guard 30 can pivot in a second direction (e.g., clockwise as shown in the illustration of FIG. 1).

Trigger 60 is shown on the underside of housing 10, and is positioned relatively forward so that trigger 60 is easily operated by the user's fingers. All other suitable positions are contemplated, including positions on the top or side of the housing 10. It is also contemplated that trigger 60 could include two, three, or more exposed protrusions that can be accessed from various positions about housing 10. Although trigger 60 is actuated by depressing trigger 60 into housing 10, it should be appreciated that trigger 60 could also be actuated by other applied forces including sliding, pressing, pulling, rotating, or other actuations. Those skilled in the art will also appreciate that trigger 60 is merely emblematic of a more general actuator, which could take the form of a button, a push button, a knob, a slider, or even multiple actuator mechanisms and so forth.

In FIG. 3, utility knife 1 is shown with the blade guard 30 in a deployed safety position, and blade 20 is in retraced safety position inside blade guard 30. In a preferred embodiment, blade 20 is completely covered by guard 20 when both are in their safety positions. In other embodiments, blade 20 is completely disposed within housing 10 when in its safety position in a manner where cutting edge 22 is completely covered. Preferably, blade 20 is completely locked inside housing 10 when not in use and when blade 20 is in its safety position. Blade 20 can be locked into its safety position via a locking mechanism comprising at least spring 33, holder 24, guard 30, and pawl 40. Pawl 40 preferably prevents movement of the assembly by resting against stop 56.

When locked, blade guard 30 could have some play (e.g., small pivoting motion) as determined by the surrounding components of the locking mechanism. In a locked position, the play of guard 30 can be limited by housing 10 which prevents counter-clockwise pivoting, and can be limited by pawl 40 which prevents clockwise pivoting of guard 30. Preferably pawl 40 has a play of less than 5 millimeters, more preferably less than 3 millimeters, even more preferably less than 2 millimeters, and most preferably less than 1 millimeter. Preferably the play is measured between the end of pawl 40 and stop 56.

Figure 4:
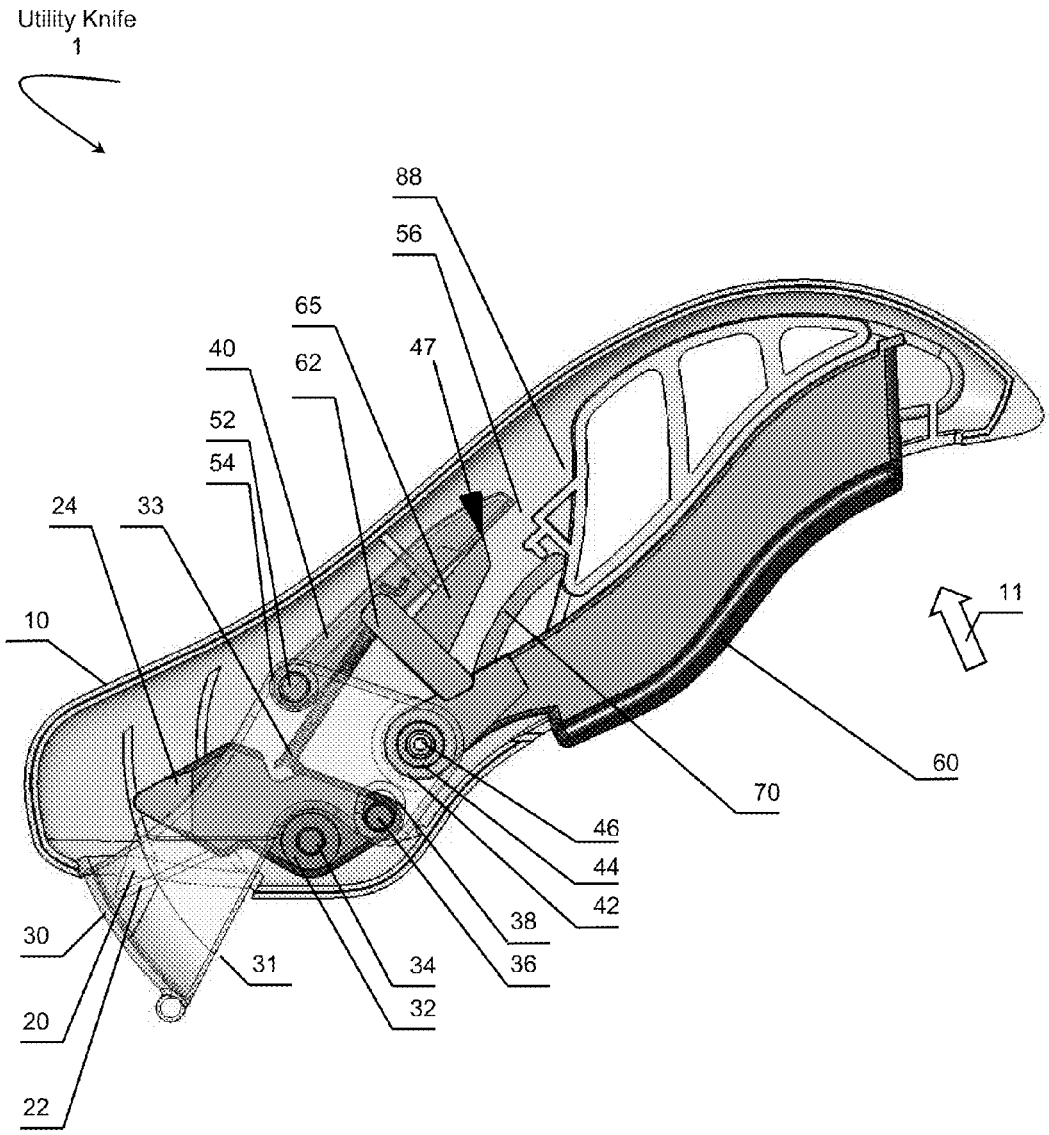
FIG. 4 is the knife of FIG. 3 where the trigger has been actuated allowing a blade guard and blade to counter-reciprocate.

In FIG. 4, trigger 60 has been depressed (e.g., squeezed) toward housing 10 in the direction of arrow 11, blade 20 is still in a safety position at least partially disposed within housing 10. Note that although trigger 60 has been actuated, blade holder 24, blade 20, and blade guard 30 have not moved or pivoted. One should also note that lever 70 is now in a flexed position and provides a restoring force to trigger 60. Once a user releases trigger 60, preferably trigger 60 automatically returns to an un-actuated stated due to the restoring force supplied by lever 70. The restoring force can also be supplied by alternative means beyond lever 70 including an elastic band, a spring, multiple levers, or by other spring-like materials.

As trigger 60 is actuated, connector 62 moves upward and lifts lifting arm 65. Lifting arm 65 engages with catch 47, assuming knife 1 is in a locked state. As lifting arm 65 moves upward, it also lifts pawl 40 in a manner where pawl 40 is freed from stop 56. Pawl 40 is now in an unlocked state, as is blade guard 30. One should note that pawl 40 does not necessarily move rearward automatically. In fact, in a preferred embodiment, pawl 40 remains in a forward position until pressure is applied to blade guard 30. As pressure is applied to blade guard 30, preferably from a surface to be cut, blade guard 30 is free to pivot about pin 46 and retract back into housing 10, which in turn causes pawl 40 to move rearward toward stop 88.

Figure 5:
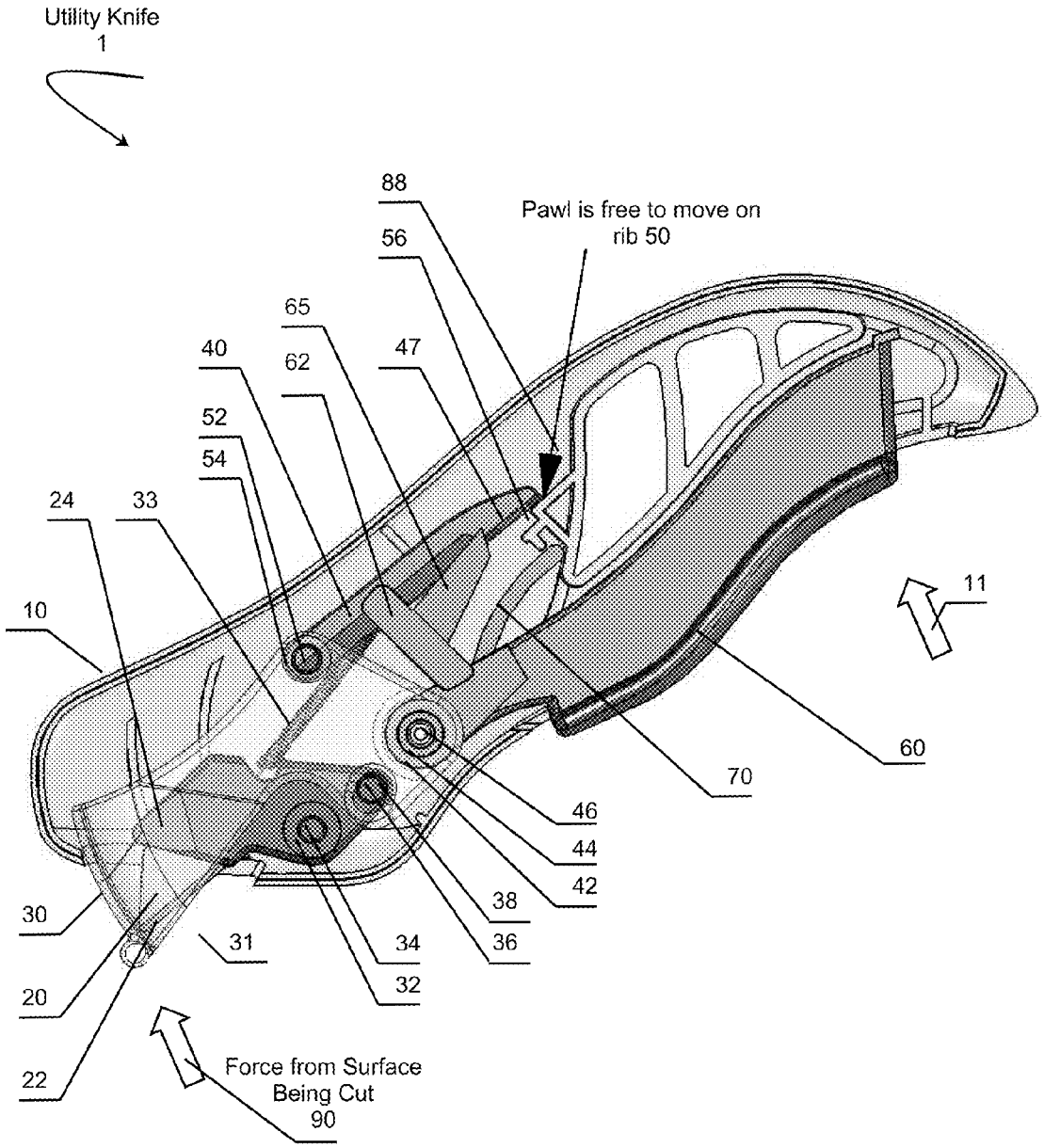
FIG. 5 is the knife of FIG. 4 where the trigger remains actuated and the blade and blade guard counter-reciprocate.

In FIG. 5, a force is applied to blade guard 30 in approximately the direction of arrow 90. Preferably the force is due to a surface that is being cut. As blade guard 30 reciprocates back into housing 10 by pivoting about pin 46, guard 30 pushes pawl 40 rearward via their translating pivot point (e.g., pin 52 and slot 54). In a preferred embodiment, pawl 40 can be guided rearward along a rib 50 toward stop 88. Additionally, reciprocation of guard 30 also causes the translating pivot point defined by pin 36 to move upward carrying slot 38 upward as well, which in turn causes blade holder 24 to counter-reciprocate relative to blade guard 30 by pivoting about pin 34. The counter-reciprocation causes blade holder 24 to rotate forward, thus exposing blade 20 for use via opening 31.

One should note the pin 36 and slot 38 do not necessarily have a precise fit. In some embodiments, as shown, slot 38 provides a groove in which pin 36 moves as necessary. In a preferred embodiment, slot 38 is sized, dimensions, and shaped to allow pin 36 to move according to a desired path. As a result, slot 38 lacks circularity, but could be formed as an oval, an elongated track, or other type of groove.

Note that spring 33 has been extended and is under further tension than when knife 1 is in a locked state. The force supplied by spring 33 biases the internal locking mechanism and pivoting coupling mechanism to return to a closed safety position, and preferably to return automatically to a locked state.

Figure 6:
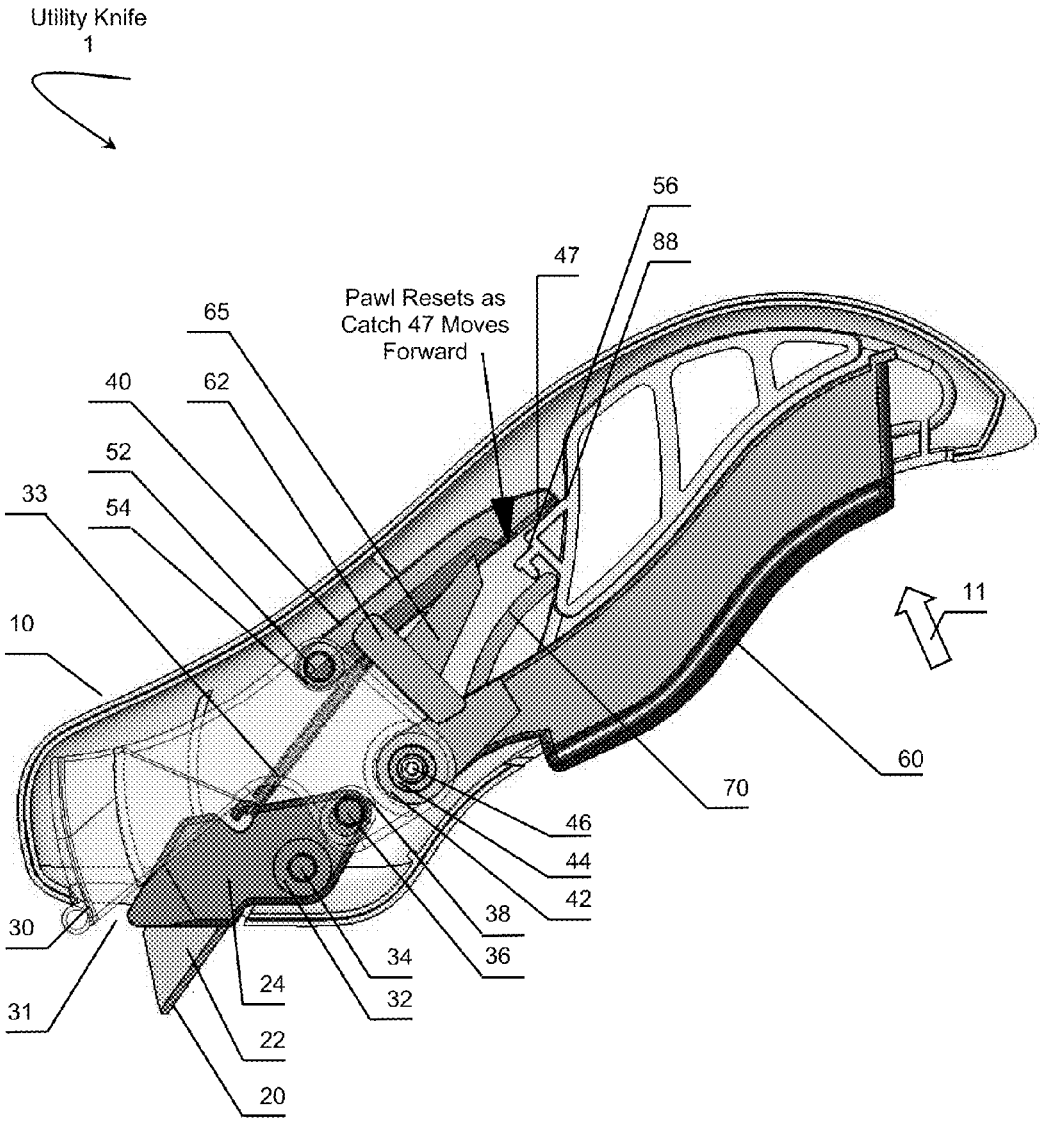
FIG. 6 is the knife of FIG. 5 where the blade is fully exposed and the locking mechanism can be reset.

In FIG. 6, knife 1 has blade 20 in fully deployed position. Blade guard 30 has substantially reciprocated back into housing 10 to a retracted position. Blade holder 24, and blade 20, has counter-reciprocated out of housing 10 into a fully deployed cutting position. One should note that knife 1 remains in a deployed position via a force applied to blade guard 30, preferably from a cutting surface, as opposed to a force originating from trigger 60.

When the force on blade guard 30 is removed, the internal assembly automatically returns to a safety position, preferably also resetting the locking mechanism. For example, guard 30 pivots forward out of housing 10 while blade holder 24 pivots back into housing 10 by pivoting in an opposite direction to that of guard 30. Additionally, pawl 40 slides forward. Note that catch 47 preferably does not re-engage lifting arm 65 until trigger 60 is released and re-actuated again. If blade guard 30 is allowed to return toward its safety position, pawl 40 drops and resets the locking mechanism by engaging with stop 56. One should note that while blade 20 is deployed, actuation of trigger 60 has no effect.

Although knife 1 is shown has a single unitary device, it is also contemplated that the internal mechanism comprising at least the blade and blade guard can be part of a removable cartridge. In some embodiment the cartridge can comprise the blade 20, blade holder 24, blade guard 30, and pawl 40. A suitable cartridge system that can easily incorporate the disclosed subject matter is co-pending patent application having Ser. No. 12/391,729 to Votolato titled "Utility Tool Having Interchangeable Tool Cartridges" filed on Feb. 24, 2009.

The disclosed knife and internal mechanisms afford many benefits and advantages. For example, the cutting edge of the knife always remains covered until the knife is applied to a surface to be cut. Another benefit is that a single actuation of a trigger allows for a single cutting operation. Yet still, another benefit includes that pressure applied by a user to a surface aids in forcing the cutting edge into the surface via leverage created by the internal coupling mechanism of the blade holder, the housing, and the blade guard. Additionally, if a user tampers with the blade guard causing the blade guard to break off, the blade will extend out of the knife handle. The blade will remain disposed within the handle and thus cannot cause accident injuries or damage. Since the blade is always behind the blade guard or in the housing, this provides significant safety and double protection against a user from being cut.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A hand-held utility knife, comprising:

a knife handle forming a housing sized and dimension to fit in a hand of a user;

a knife blade placed in a blade holder at least partially disposed within the knife handle housing;

a blade guard at least partially disposed within the knife handle housing;

a coupling mechanism including at least three pivot points that couples reciprocation of the knife blade and the blade guard such that forced retraction of the blade guard results in forced extension of the knife blade;

wherein the knife blade holder and the blade guard each pivotally couple internally to the knife handle at separate internal pivot points in a manner where, in preparation for use, force from a surface on the blade guard causes the knife blade and the blade guard to simultaneously counter-reciprocate within the knife handle housing by the knife blade extending further out of the knife handle housing through pivoting relative to the knife handle, and at the same time the blade guard retracting further into the knife handle housing through pivoting in an opposite direction relative to the knife handle to that of the knife blade; and where the blade holder pivots about a first stationary pivot point relative to the housing, and the blade guard is pivotally coupled to the blade holder at a second translating pivot point.

2. The utility knife of claim 1, where in the housing comprises, a first pivot point that pivotally couples the housing to the knife blade, and a second pivot point that pivotally couples the housing to the blade guard.

3. The utility knife of claim 1, further comprising a spring that biases the blade guard in a closed safety position.

4. The utility knife of claim 3, wherein the spring also biases the knife blade toward a retracted safety position within the housing.

5. The utility knife of claim 1, wherein the knife blade is substantially covered by the housing when not in use.

6. The utility knife of claim 1, further comprising a locking mechanism configured to prevent counter-reciprocation of the knife blade and the blade guard while the locking mechanism is locked.

7. The utility knife of claim 6, further comprising a trigger configured to release the locking mechanism from a locked state to allow counter-reciprocation of the knife blade and the blade guard.

8. The utility knife of claim 7, wherein actuation of the trigger does not cause movement of the blade guard.

9. The utility knife of claim 7, wherein the locking mechanism is further configured to allow a single use of the knife blade upon actuation of the trigger.

10. The utility knife of claim 9, wherein the locking mechanism automatically locks upon return of the blade guard to a safety closed position.

11. The utility knife of claim 6, wherein the locking mechanism comprises a pawl and a spring where the spring biases the pawl to prevent counter-reciprocation of the knife blade and the blade guard when the locking mechanism is locked.

* * * * *